US007360665B1

(12) United States Patent
Hartelius

(10) Patent No.: US 7,360,665 B1
(45) Date of Patent: Apr. 22, 2008

(54) GIFT BASKET ASSEMBLIES

(76) Inventor: Mark E. Hartelius, 8112 Komensky, Chicago, IL (US) 60652

( * ) Notice: Subject to any disclaimer, the term of this patent is extended or adjusted under 35 U.S.C. 154(b) by 286 days.

(21) Appl. No.: 10/913,708

(22) Filed: Aug. 6, 2004

Related U.S. Application Data

(60) Provisional application No. 60/493,384, filed on Aug. 6, 2003.

(51) Int. Cl.
*B65D 25/10* (2006.01)
*B65D 25/32* (2006.01)
*B42F 17/14* (2006.01)

(52) U.S. Cl. ..... 220/759; 220/760; 220/559

(58) Field of Classification Search ..... 220/760, 220/767, 769, 770, 773–776, 761, 762
See application file for complete search history.

(56) References Cited

U.S. PATENT DOCUMENTS 248,682 A * 10/1881 White ..... 220/762
987,579 A * 3/1911 Koenig ..... 220/762
1,575,232 A * 3/1926 Shearer ..... 294/33
2005/0011792 A1* 1/2005 Scott ..... 206/457

* cited by examiner

*Primary Examiner*—Anthony D. Stashick
*Assistant Examiner*—Shawn M. Braden
(74) *Attorney, Agent, or Firm*—Robert W. J. Usher

(57) ABSTRACT

A basket assembly has an open top base container, a strap form handle having attachment clips at opposite ends snap-fitted into apertures on opposite wall portions of the base container adjacent the rim to upstand in bowed condition from the rim; a product/gift display board and, fasteners for attaching the handle to the display board so that the display board extends vertically above the rim. The handle has outrigged hooks adjacent the attachment clips for hooking over the container rim to stabilize the handle on the container and shoulder portions with board mounting protuberances locating a lower edge of the display board resting on the shoulders. The fasteners have clasp portions for receiving intermediate portions of the handle as a snap fit and are integrally molded with board anchoring portions which receive securing posts to anchor the handle to the display board.

2 Claims, 12 Drawing Sheets

GIFT BASKET ASSEMBLIES

RELATED APPLICATION

Priority is claimed from my provisional application 60/493,384 filed Aug. 6, 2003, the disclosure of which is incorporated herein by reference.

FIELD OF THE INVENTION

The present invention relates to gift baskets/container assemblies in which loop form handles extend across the tops of baskets/base containers and a product displaying board (blister card) upstands behind the handle and particularly to means of attaching the handles to the baskets/base containers and to the display boards.

BACKGROUND OF THE INVENTION

Traditionally, so-called Easter Baskets, comprised wicker baskets with loop form handles extending across the top and supporting a product displaying board (blister card) upstanding from the basket.

However such wicker baskets can be relatively expensive and of variable quality in terms of strength and durability.

Largely for reasons of economy, it is proposed to replace the wicker gift basket by a sheet walled metal basket/container similar to a large popcorn tin or by a plastic basket.

However problems have arisen both in attaching handle straps to the baskets and in attaching the display boards to handle straps for stably mounting the display boards.

The traditional method of attaching the display board to the handle strap involves twist ties or cable type ties passed through a pair of apertures in the display board. However this procedure is fiddlesome, relative time consuming and hard on the fingers of the assembly workers.

SUMMARY OF THE INVENTION

It is an object of the invention to provide a display/gift basket assembly which is relatively easy to manufacture and assemble at low cost display/gift basket assembly According to one aspect of the invention, the handle straps of the display/gift basket assemblies have clip form attachment portions at respective ends which can be attached to a basket or base container with a simple pushing action.

According to another aspect of the invention, a fastener comprises an anchoring portion having a stud like securement to the display board and a clasp portion for receiving and securing the handle strap to the display board.

The invention provides a basket assembly comprising a base container and a strap form handle therefor, the base container having an open top defined by rims of opposite vertical side wall portions formed with handle receiving apertures spaced below the top and the handle being a one-piece, molded, elongate, plastic strip with a major plane and respective opposite longitudinal ends formed with handle attachment clip portions by which said handle is mounted to respective opposite sidewall portions by receipt in respective handle receiving apertures, so that the handle upstands in bowed condition vertically above said open top, and wherein each handle attachment clip portion comprises a relatively rigid body portion having an upper end joining the strap portion and outer and inner resiliently flexible latching limbs, depending in side by side relation from outer and inner locations of a lower end of the body portion, the outer limb initially extending from the strap portion and terminating at a lower end in a catch portion which protrudes inwards toward the inner depending limb, the catch portion having an upper rear catch surface and an inclined lower, leading camming surface;

the inner depending limb comprises a pair of leg portions extending side by side from the body and joined at a lower, leading end, by a loop portion, the leg portions and loop portion extending around the outer limb, adjacent and spaced apart therefrom and bowing inward away from the outer limb as they extend from the body and then extending back outward and continuing as a central portion which is outwardly inclined so that it surrounds the catch portion of the outer limb and the loop portion inclining inwardly towards its lower end, away from the camming surface of the catch portion to define therewith a downwardly divergent, rim receiving mouth;

U-shape, stiffly resilient, stabilizing arm portions extend from respective opposite transverse sides of the body portion with one of their respective arms joined thereto and another, remote arm, terminating in an inwardly extending latching hook for engaging over the rim, whereby the handle can be assembled with the base container by holding the strap portion with the mouth of the handle attachment clip portions receiving the rim and the catch aligned above an aperture and with the hooked portions of the stabilizing outriggers extending over the rim, while steadying the handle by supporting the loop portion on the inside of the rim, and pushing the strap portion down causing the handle attachment clip portion to slide down the wall portion which is received between the inner and outer limbs and received in the hooked portions of the stabilizing outriggers until the catch snaps into the locking aperture and, so that the hooked ends of the stabilizing outriggers engage the rim in stressed condition in a final latching position, biasing the catch upwards in the locking aperture to maintain the catch engaged against an upper edge portion of the aperture, stabilizing the attachment of the handle and, together with the outriggers, preventing twisting and tilting, maintaining the handle upstanding from the base container.

Preferably, the basket assembly further comprising a display board having a face and a lower edge portion, the display board being mounted on said open top with said lower edge portion resting on the attachment portions and a plurality of fasteners securing the face of the display board to the handle strap with the plane of the handle strap extending perpendicularly to the display board thereby to maintain the display board upstanding from said open top, wherein each of said one of the respective arms of the stabilizing arm portions are joined to respective opposite transverse sides of the body portion from which they extend by a respective shoulder portion coplanar with the strap and display board locating protuberances upstanding from each shoulder portion at a location spaced from the strap portion so that the lower edge of the display board is trapped between the protuberances and the strap, resting on the shoulders.

Desirably, each fastener is molded in one piece of plastic and comprises a board anchoring portion integrally connected by a web hinge to a clasp portion and post means for penetrating the display board and engageable with the anchoring portion for fixing the anchoring portion to a face of the display board:

the clasp portion comprising a pair of arms extending in spaced apart, parallel relation away from the anchoring portion and joined at a remote end by a transverse arm from a central location of which a resilient latching arm extends back toward the anchoring portion and spaced above and between the pair of arms, the resilient latching arm being formed with an inverted retention channel and terminating in a free end which extends upwardly away from the pair of arms providing a widening mouth for easy insertion of the strap, laterally, into the clasp portion between the latching arm and the pair of arms, whereby the anchoring portion is fixed to a face of the display board by engagement with the fixing means, the pair of arms extends parallel to the face of the display board and the strap can be secured to the clasp by forcible lateral insertion edge first into the mouth between the upturned free end of the latching arm and the pair of arms so as to flex the latching arm away from the pair of arms until the rib snaps into the retention channel permitting the latching arm to return to extend parallel to the display board trapping the strap in the clasp portion; and the clasp portion and strap are then pivoted through a right angle about the web hinge to extend perpendicularly to the display board.

Preferably, a clasp portion retention stop upstands from the anchoring portion and engages and traps the upwardly extending free end of the resilient latching arm during pivotal movement of the clasp portion and strap, thereby retaining the clasp portion and strap pivoted to extend perpendicularly to the face of the display board. More, specifically the post means has a free end which penetrates through the board anchoring portion to upstand therefrom and the clasp portion retention stop is provided by the free end of the post. The free end of the post may be wasted to provide a circumferential recess, receiving and retaining the free end of the resilient latching arm of the clasp portion.

According to another aspect, the invention provides a basket assembly comprising a base container and a strap form handle therefor, the base container having an open top defined by opposite vertical side wall portions, formed with handle receiving apertures and the handle being a one-piece, molded, elongate, plastic strip with a major plane and respective opposite longitudinal ends formed with handle attachment clip portions by which said handle is mounted to respective opposite sidewall portions by receipt in respective handle receiving apertures, so that the handle upstands in bowed condition vertically above said open top, and wherein each handle attachment clip portion comprises a latching button horizontally split to provide an enlarged hook form, tapering, bipartite latching head on a neck molded on a inner surface aligned, spaced apart and below, an inwardly protruding, stabilizing limb member, whereby the handle can be assembled with the container by engaging the stabilizing tab from an outside over the rim at a location aligned above a handle receiving aperture and, pushing down to resiliently flex the stabilizing tab until the latching head is in registration with the latching aperture and manually pushing the strap portion behind the button from the outside into a respective latching aperture so that engagement of the cam form leading ends of the latching head with the edge portions of the locking aperture, cams the parts of the latching together by resiliently flexure thereof, enabling the latching head to be forced into the aperture with a snap action so that residual resilient flexure of the stabilizing tab and latching head halves provides a tensioning force which assists in stabilizing the handle secured to the container.

The stabilizing limb member may comprises a flat tab or a pair of stiffly resilient, stabilizing outrigging arms which have first portions extending with a slight downward inclination in opposite transverse directions from respective opposite side edges of the strap portion and second, inwardly extend hooked, rim engaging portions,

BRIEF DESCRIPTION OF THE DRAWINGS

In order that the invention may be readily understood, embodiments thereof will now be described by way of example only and with reference to the accompanying drawings in which.

PARTICULAR DESCRIPTION

Figure 1:
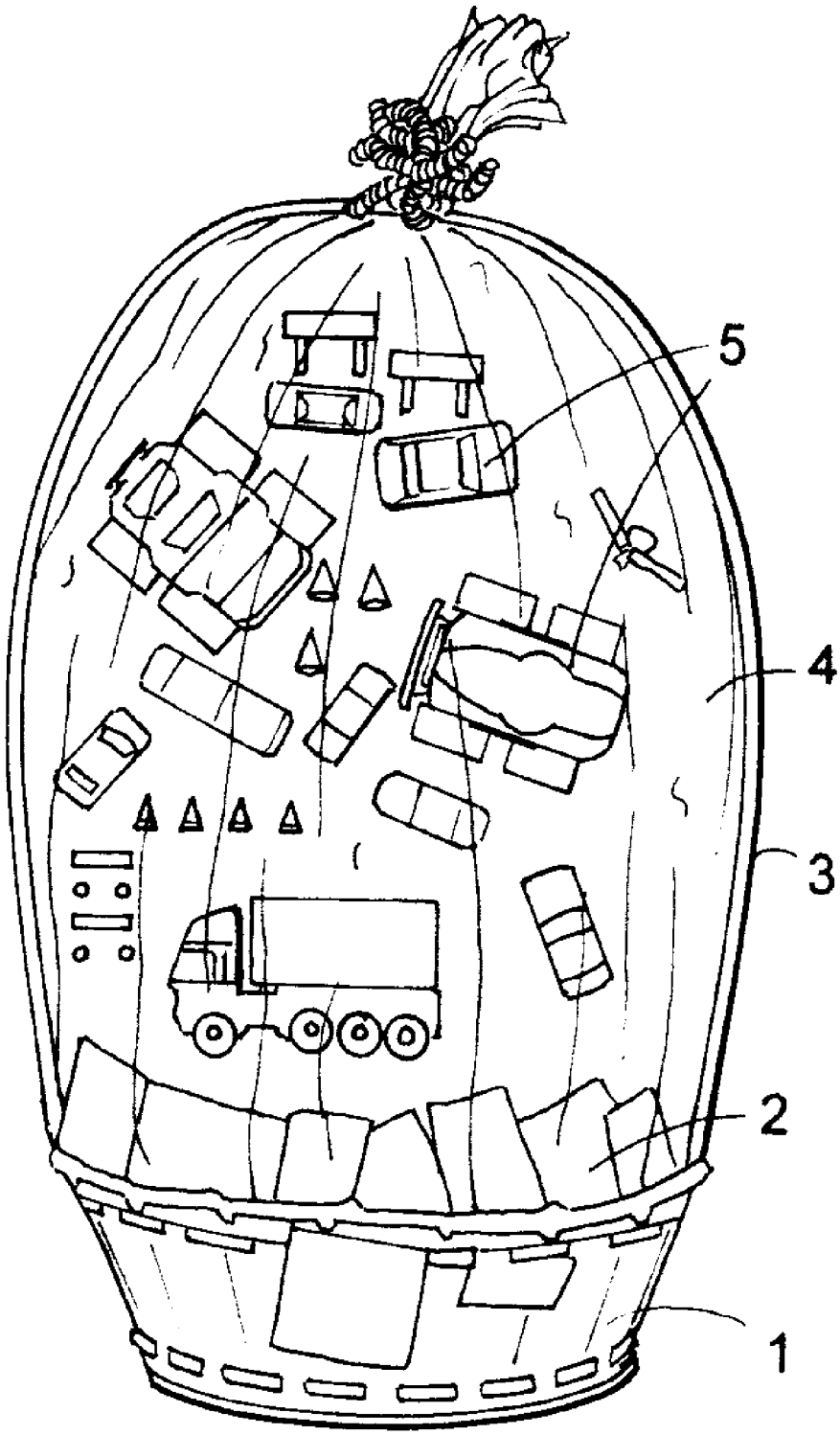
FIG. 1 is a photograph of a front elevation of a traditional wicker Easter Basket of the prior art.

As show in FIG. 1, the traditional wicker Easter Basket assembly has a base container 1 filled with candy 2, a loop form handle 3 upstanding from opposite sides of the base container across the top and an upstanding display board 4 carrying children's toys 5 and attached at intervals around its peripheral edge to the handle.

Figure 2B:
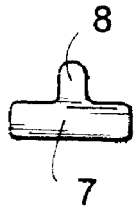
FIGS. 2*a* and 2*b* are schematic front elevational and sectional views of a handle strap with attachment portions at respective ends for fastening to a basket having a sheet form sides of metal or plastic.
Figure 2A:
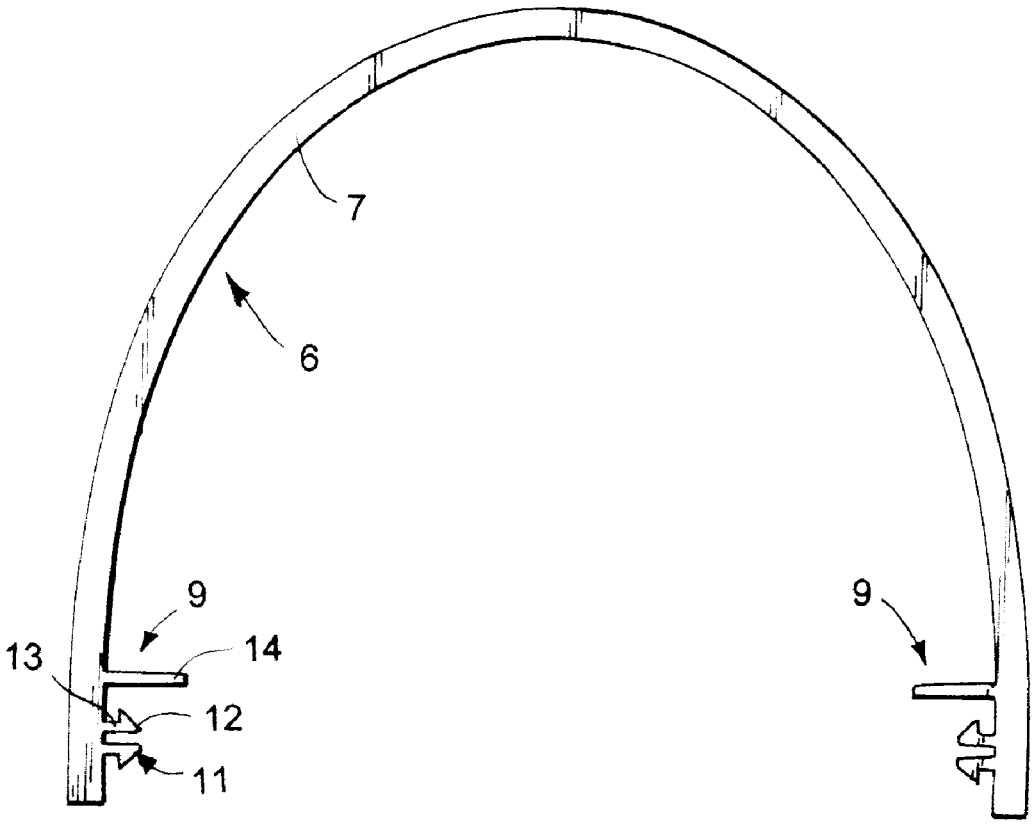

As shown in FIGS. 2*a* and 2*b*, a first embodiment of handle 6 for a sheet walled metal or plastic container is molded in one-piece of plastic with a strap portion 7 having a strengthening rib or spine 8 extending along a top, outer surface and identical attachment portions 9 at respective opposite ends. Each attachment portion comprises a horizontally split latching button 11 with a enlarged hook-form, tapering, cam form, flat sided, latching head 12 on a neck 13 molded on a inner surface aligned, spaced apart and below, an inwardly protruding, flat stabilizing tab 14.

Figure 3:
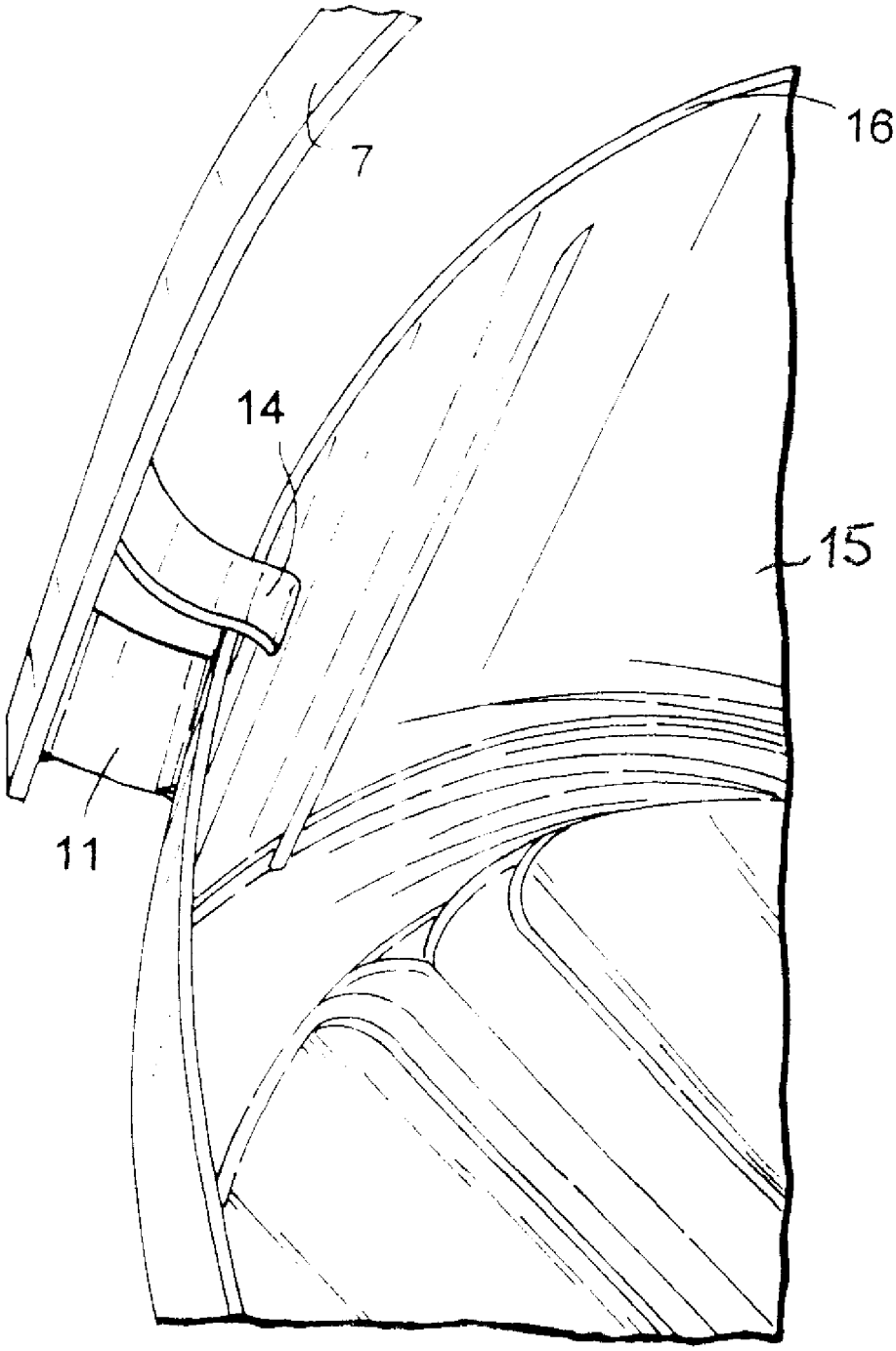
FIG. 3 is a fragmentary view of a tin form container/basket during attachment of one end of the handle strap thereto.

The base container or basket member 15 has opposite sidewalls formed with locking apertures adjacent a top rim 16. The handle is assembled with the container by engaging a stabilizing tab 14 from the outside over the rim at a location aligned above the locking aperture and, pushing down slightly to resiliently flex the stabilizing tab 14 until the head is in registration with the locking aperture and manually pushing the strap portion behind the button from the outside into a respective aperture, as indicated in FIG. 3.

Engagement of the cam form leading ends of the latching head with the edge portions of the locking aperture, cams or squeezes the hook halves together by resiliently flexure thereof, enabling the head to be forced into the aperture with a snap action.

Residual resilient flexure of the stabilizing tab and hook halves provides a tensioning force which assists in stabilizing the handle secured to the container.

However, a relatively close fit or interference fit of the latching head in the locking aperture is required for security and stability such that the action of repeatedly registering and forcing the latching heads into the locking apertures against the resilient resistance of the latching head and stabilizing tab can imposes considerable stresses on an assembly worker's fingers over time, with risk of minor strain, soreness or blistering, which makes assembly undesirably arduous and slows the assembly rate.

Figure 4B:
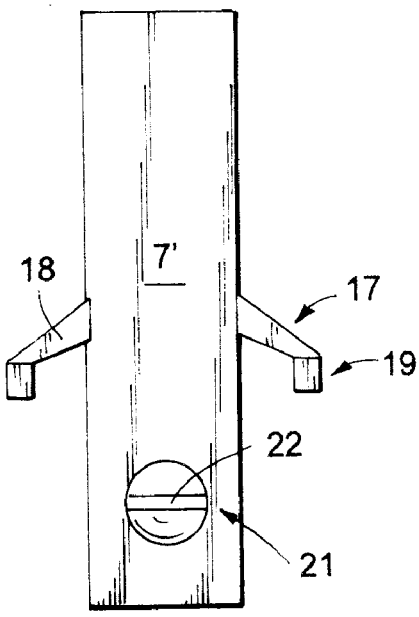
FIGS. 4*a*-4*c* are schematic views of an attachment end of another embodiment of handle with stabilizing outriggers.
Figure 4A:
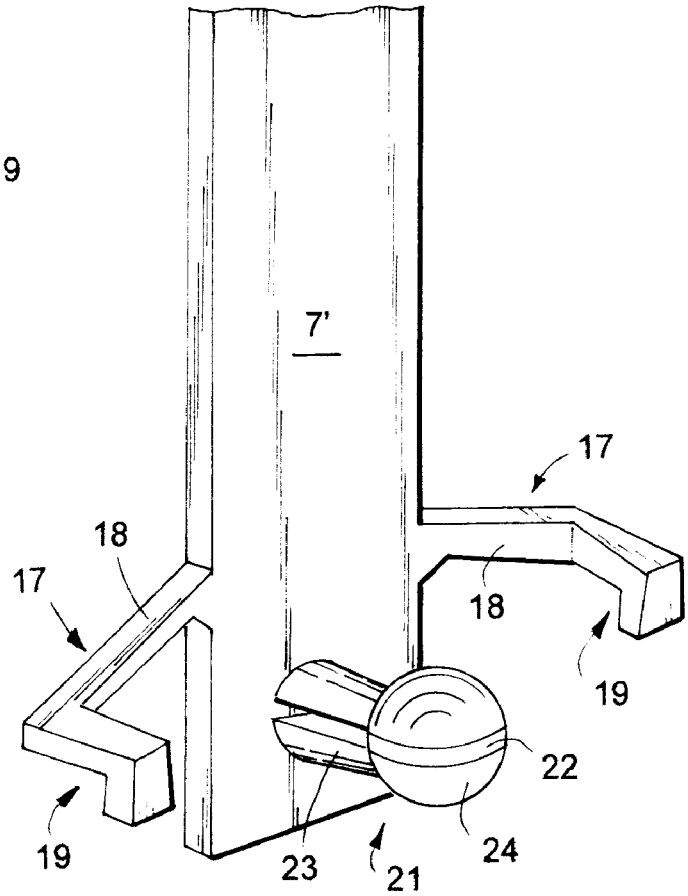
Figure 4C:
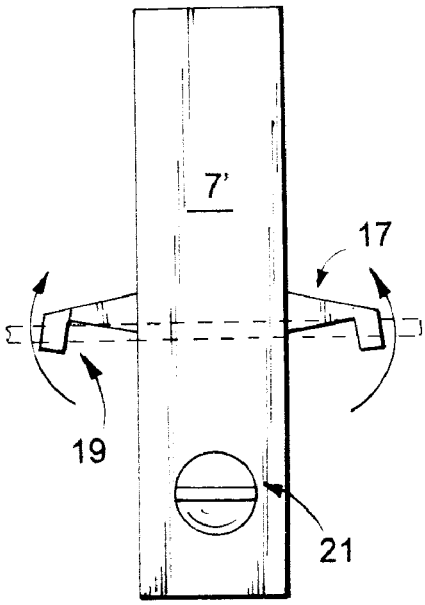

In another embodiment, shown in FIGS. 4*a*-4*c*, for improved handle stability, the single stabilizing tab 14 is replaced by a pair of resilient stabilizing arms or outriggers 17 which have first portions 18 extending with a slight downward inclination in opposite transverse directions from respective opposite side edges of the strap portion 7 and second, inwardly extend hooked, rim engaging portions 19. The latching head 21 is peg-like with a rounded profile with a diametrical slit 22, a gently tapering cylindrical neck 23 and a substantially spherical latching head 24.

The assembly procedure is similar to that described for the first embodiment, with both outriggers of stabilizing arms remaining resiliently flexed and remaining when the latching head is inserted into the locking aperture.

Although, the second embodiment can provide greater transverse or lateral stability to maintain the handle upstanding vertically from the base container and is somewhat easier to assemble as the assembler can engage and flex each stabilizing arm separately while the round profile of the camming head enables easier registration and insertion of the latching head into the locking aperture, the assembly process is still relatively arduous and wearing on the assembler's hands, reducing mass production.

Figure 5:
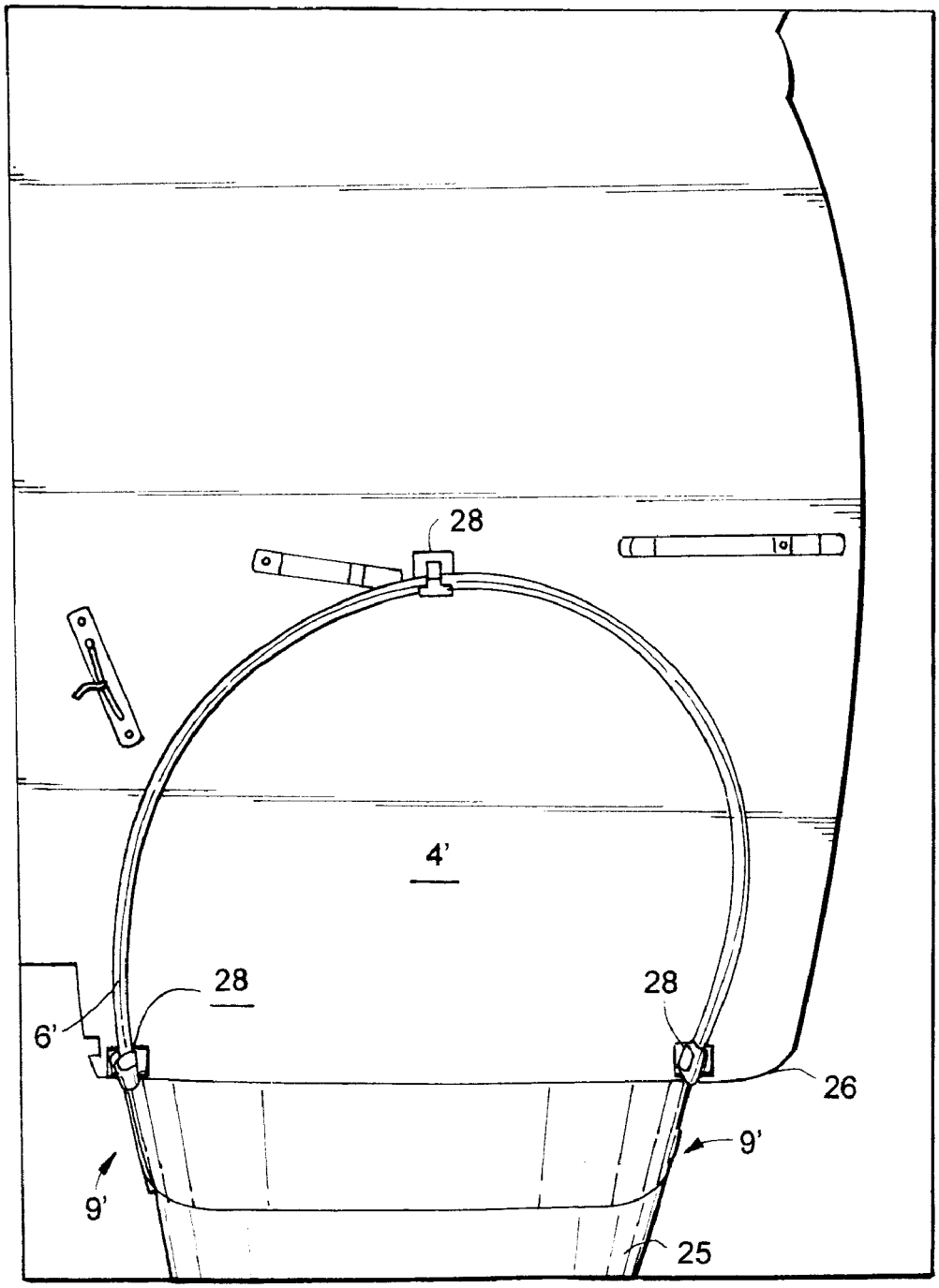
FIG. 5 is a photograph of a front of another display/gift basket assembly with the gifts omitted from the display board for clarity.

As shown in FIG. 5, in a further embodiment the basket assembly of the invention comprises a plastic base container (or basket) 25 with a loop form handle 6' mounted to opposite minor sidewalls by respective attachment portions 9' and a display board 4' mounted with a lower edge portion 26 resting on the attachment portions and maintained upstanding by three fasteners 28 which secure the display board to the handle strap 6' with the plane of the handle strap extending perpendicular to the display board.

Figure 6B:
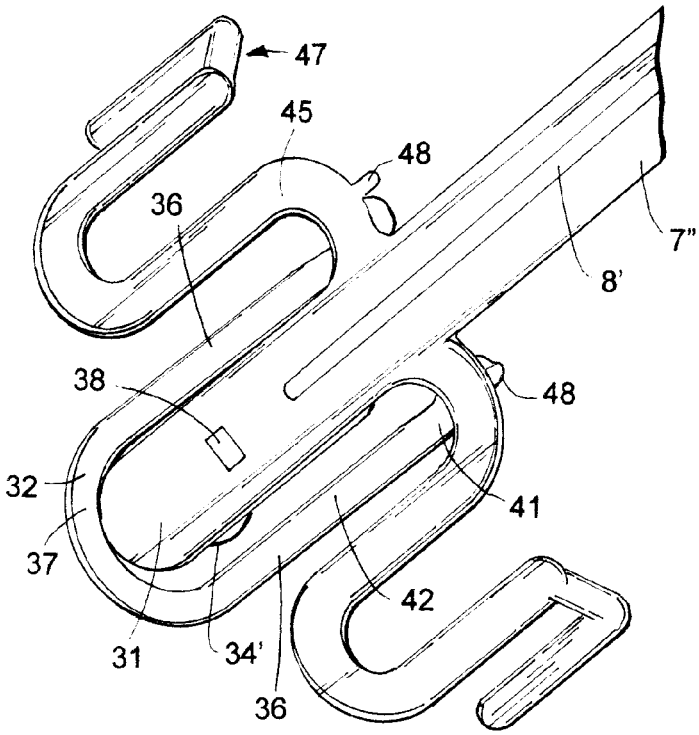
FIGS. 6*a*-6*d* are schematic isometric views of the attachment end of another handle showing, obliquely, inner and outer sides, an inside view and a side elevation and respectively, of another, clip form attachment portion.
Figure 6A:
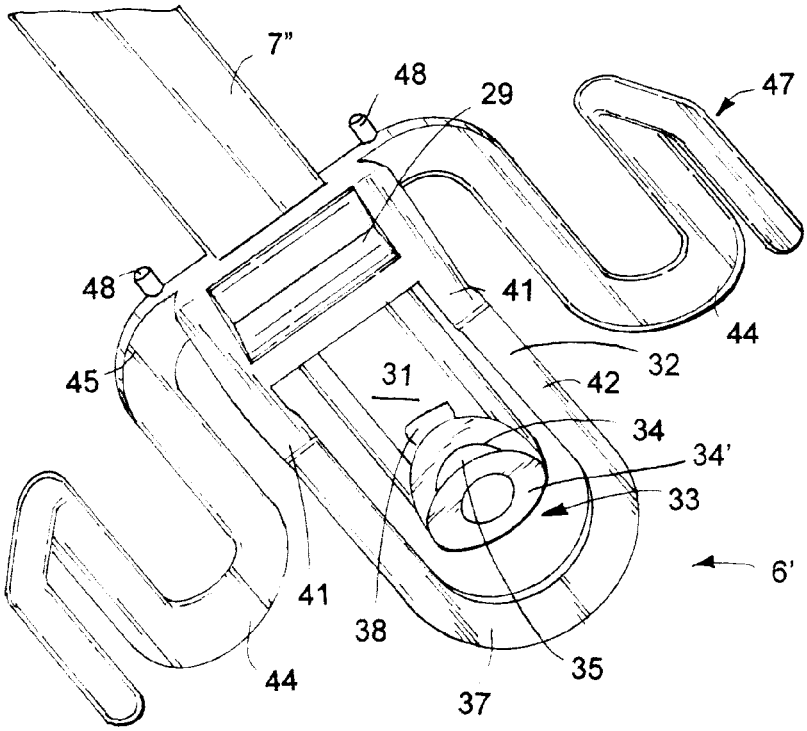
Figure 6D:
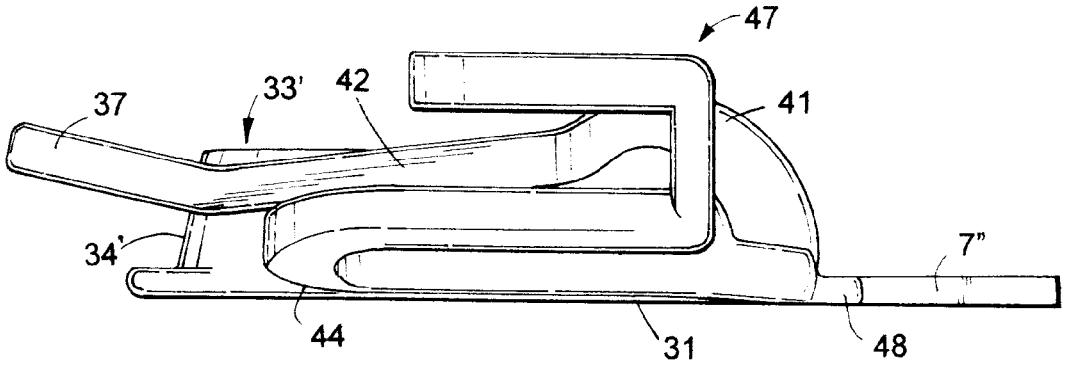
Figure 6C:
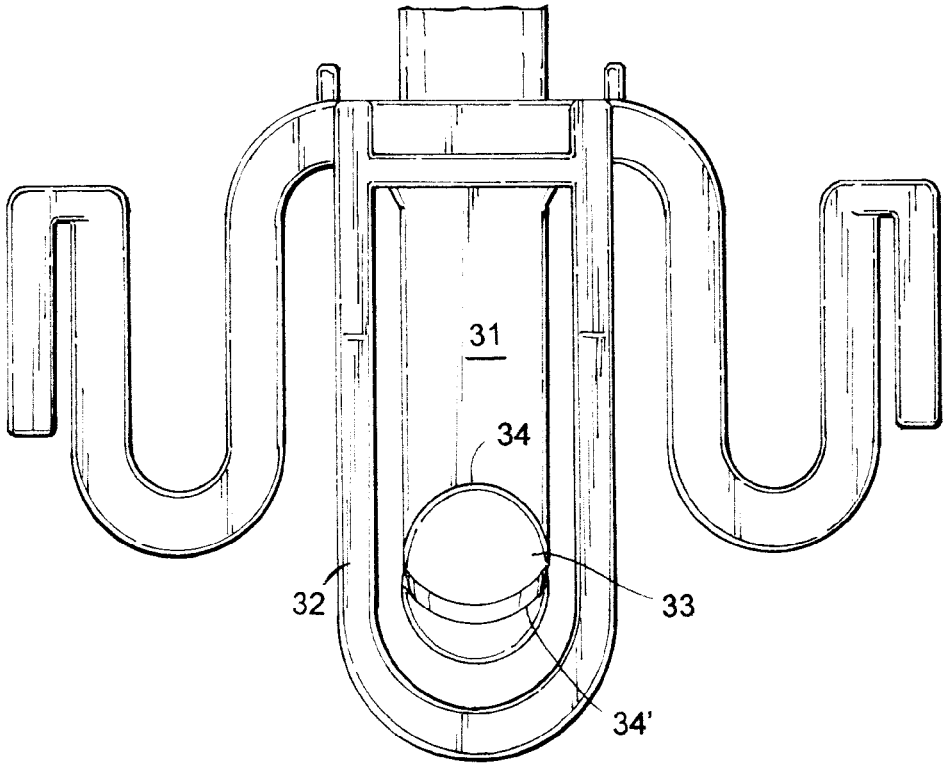
Figures 7A, 7B, 7C, 7D:
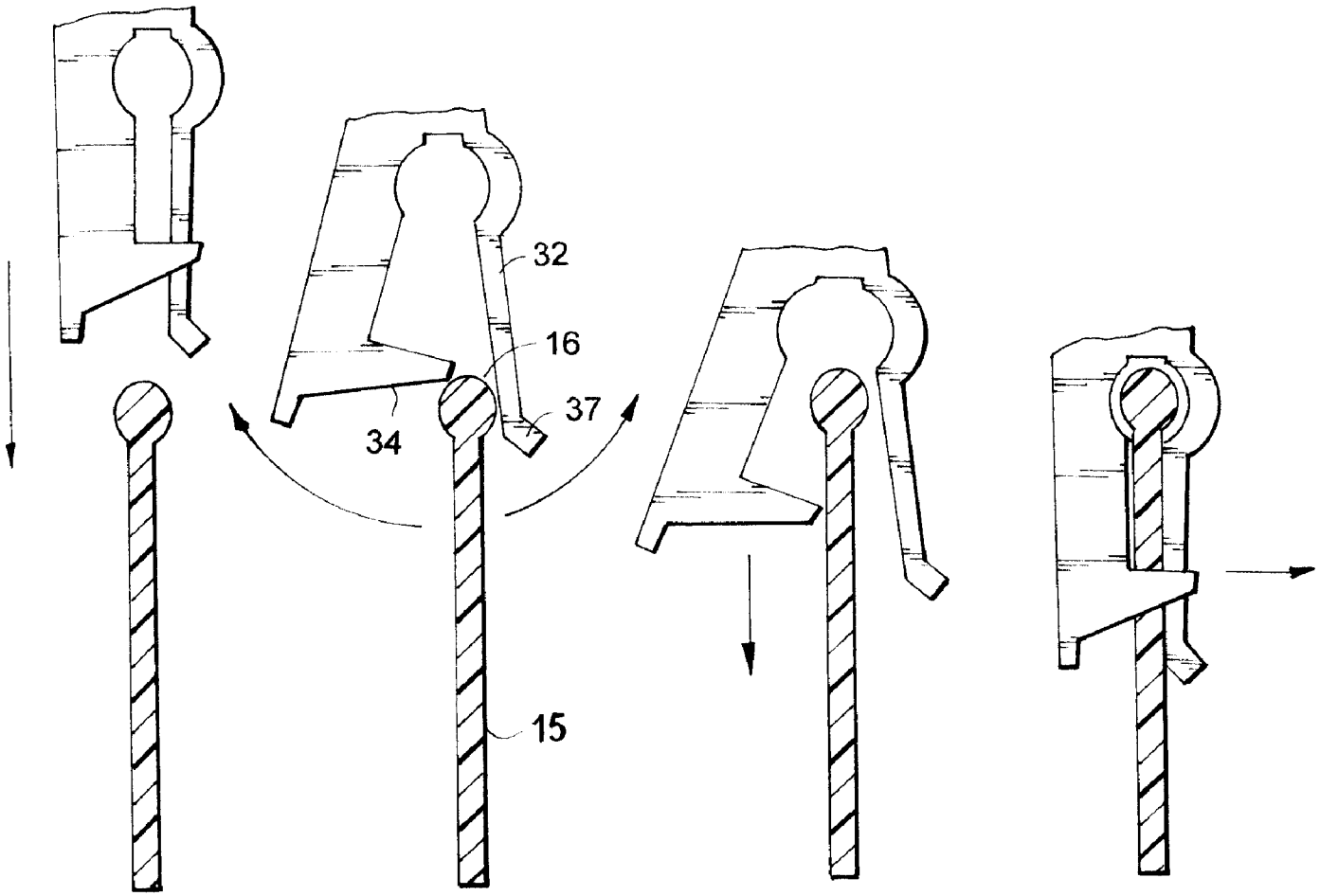
FIGS. 7*a*, 7*b*, 7*c*, and 7*d*, illustrate, schematically, sequential steps in attaching the handle to a (tin) base container/basket.

As shown in FIGS. 6*a*-6*c*, each handle attachment portion 6' comprises a relatively rigid body portion 29 having an upper end joining the strap portion 7" and outer and inner resiliently flexible latching limbs 31 and 32, respectively, depending in side by relation from outer and inner locations of a lower end of the body portion. The outer limb 31 initially has the general form of an extension of the strap portion and terminates at a lower end in a catch portion 33 which protrudes inwards toward the other depending, inner limb 32. The catch portion is generally cylindrical and has a rear/upper cylindrical face 34 and a leading/lower face 34' which is inclined inward or chamfered towards a bottom end to provide a leading camming surface and, one version, is optionally formed at a rear end with an upstanding tab-like hook indicated at 35 in FIG. 6*a* and shown more clearly in FIG. 8. It will be understood that a through-aperture indicated at 38 can be formed behind the tab-like hook to admit a mold core to permit the hook to be formed by molding. However, normally, the hook is not provided, as shown in FIGS. 6*c* and 6*d*, and aperture 38 is omitted.

The other depending, inner limb 32 comprises a pair of leg portions 36 extending in parallel relation from the body and joined by a loop portion 37 at a lower, leading end. As seen in FIG. 6*d*, the leg portions 36 initially bow inward at 41 away from the outer limb 31 as they extend from the body and continue with a central portion 42 inclined outward so that it extends into the same plane as, and surrounds, the catch portion 33 of the outer limb, and the loop portion 37 inclines inwardly from central portion 42 toward the lower end away from the camming surface of the catch to define therewith a downwardly divergent mouth to facilitate entry of the rim between them.

U-shape, stiffly resilient, stabilizing arm portions 44 extend from respective opposite transverse sides of the body portion to which they are joined by respective shoulder portions 45 coplanar with the strap and a remote arm of each U extends slightly forward so that the attachment portion 6' follows a profile of the rim of the base container and terminates in latching hooks 47 inclined obliquely inward to engage over the rim. Display board mounting protuberances 48 upstand from each shoulder portion 45 at a location spaced from the strap portion for trapping a lower edge of the display board resting on the shoulders adjacent the strap portion.

The base container or basket is molded from plastic with rectangular (or circular) apertures sized to freely receive the catch on respective opposite side walls adjacent the rim.

Figure 9:
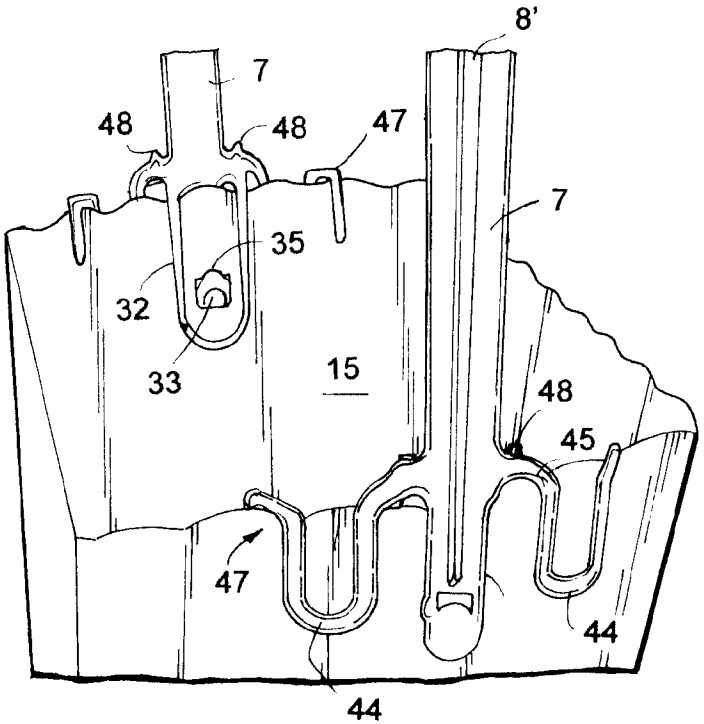
FIG. 9 shows the handle attached to a basket by the clip form attachment portions of FIGS. 6*a* and 6*b;*
Figure 8:
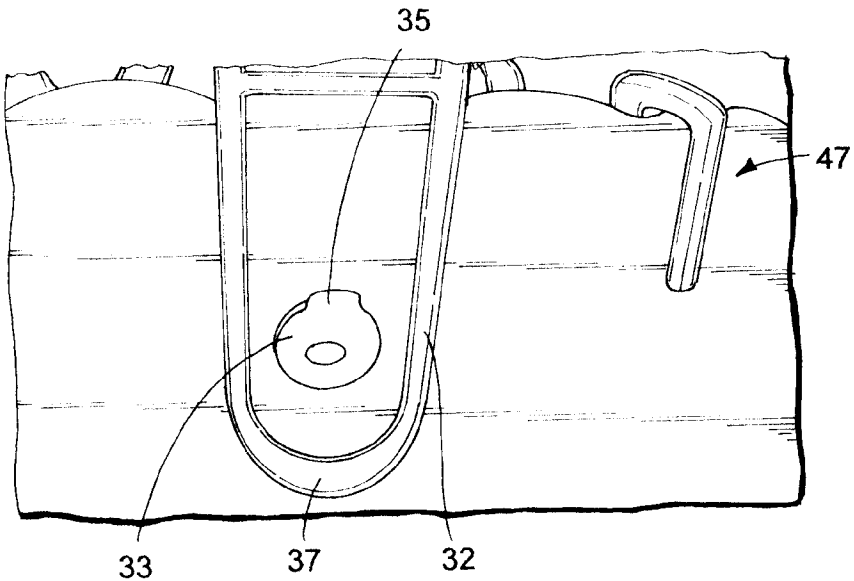
FIG. 8 is a fragmentary view showing the attachment portion latched to the basket.

The handle may be assembled with the base relatively easily by holding the strap portion and simply aligning the catch above the aperture and the hooked portions of the stabilizing outriggers over the rim while steadying the handle by supporting the loop portion on the inside of the rim and then pushing down the strap portion causing the clip to slide down the wall portion which is received between the inner and outer limbs thereof and in the hooked portions of the stabilizing outriggers until the catch snaps into the locking aperture the upper edge of which provided a downwardly facing locking abutment. A simplification of the assembly steps is shown diagrammatically in FIGS. 7*a*-7*d* and the attachment of the handle to the basket/base container is shown in FIGS. 8 and 9 (with the display board omitted). The latching hooks 47 of the stabilizing outriggers engage the rim in stressed condition in the final latching position biasing the catch 33 upwards within the locking aperture, (maintaining, when provided, the tab-like hook 35 engaged over the inside upper edge portion of the aperture,) stabilizing the attachment of the handle and, together with the outriggers, preventing twisting and tilting, maintaining the handle supporting the board upstanding from the base container. In other words, the upward tension created by the outrigging arms draws the catch upward creating the necessary tension to hold the handle in the hole.

The fastener 28 for attaching the display board to the handle strap is molded in one piece of polypropylene and comprises a board anchoring portion 51 integrally connected by a web hinge 52 to a clasp portion 53 and a separate cap member 54 with a disc like head 55 and a shank 56 outstanding from one face of the head and formed with a socket 57 of circular section.

The board anchoring portion 51 comprises a rectangular plate 58 formed with a male connector 59 of hexagonal cross section protruding from a lower face and receivable as a force fit in the socket 57.

The clasp portion 53 comprises a pair of arms 61 (see modified version of FIG. 11*a*) extending in spaced apart, parallel relation away from the anchoring portion and joined at a remote end by a transverse arm 62 from a central location of which a resilient latching arm 63 extends back toward the anchoring portion and spaced above and between the pair of arms. The resilient latching arm 63 is formed with an inverted u-shaped portion forming a retention channel 64 and terminates in a free end 65 upturned to provide a widened mouth for easy access of the strap 7 into the clasp portion between the latching arm 63 and the pair of arms 61.

Figure 10A:
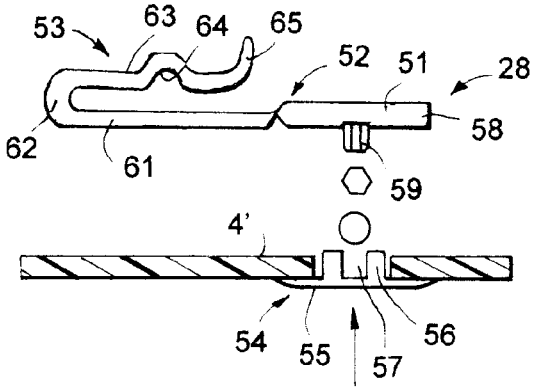
FIGS. 10*a*-10*f* are schematic views showing successive stages of mounting the fastener on the display board and attaching the handle strap to the fastener.
Figure 10B:
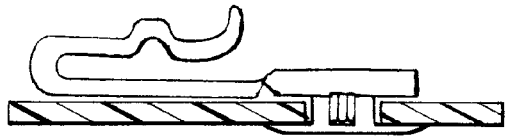

The board anchoring portion 51 is secured to the front face of the display board 4 by locating the cap head against the rear surface of the display board with the socket 57 inserted through an aperture in the display board, as shown in FIG. 10*a* and force fitting the hexagonal male connector 59 in the socket as shown in FIG. 10*b*.

Figure 10C:
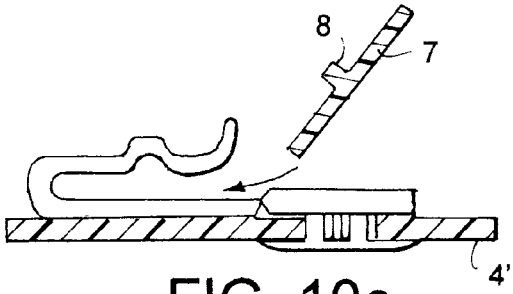
Figure 10D:
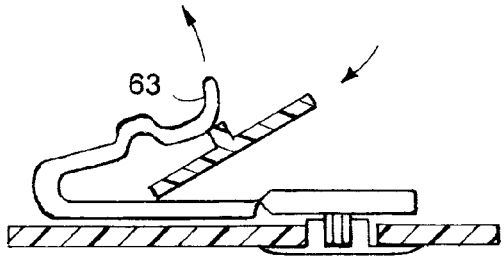
Figure 10E:
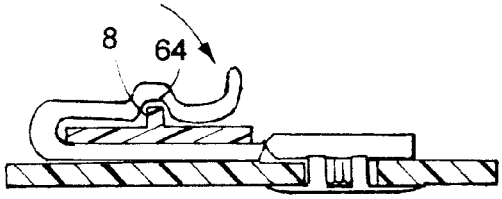
Figure 10F:
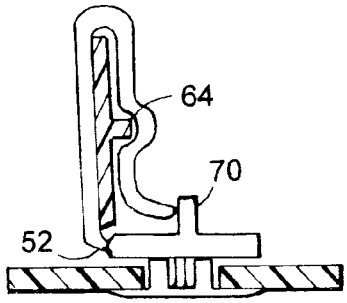

The strap 7 is secured to the clasp by lateral insertion into the mouth under the upturned free end 65 of the latching arm 63, flexing the latching arm 63 away from the pair of arms until the rib 8 snaps into the retention channel with the strap extending parallel to the display board, as seen in FIGS. 10*c* to 10*e*. The strap is then bent to extend perpendicular to the display board by flexure of the web hinge, as shown in FIG. 10*f* in which, in order to more securely maintain the strap in the clasp, the anchoring portion is modified by forming an upstanding retention rib 70 on the upper face of the anchoring portion for engagement by the free end 65 of the resilient arm to prevent or hinder any clasp opening movement thereof, the upturned shape of the free end aiding the secure engagement.

Figure 11A:
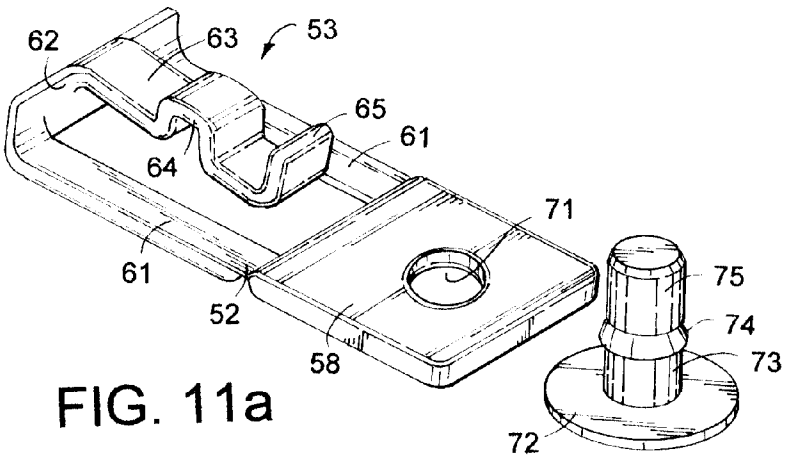
FIGS. 11*a* and 11*b* are, respectively, perspective and side views of a modified fastener with a display board fragment shown for clarity.
Figure 11B:
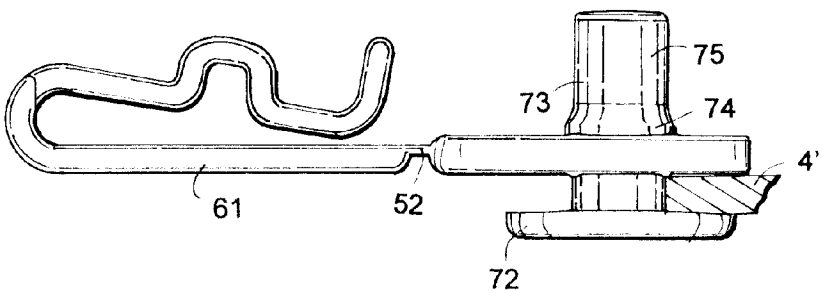

In another modification shown in FIGS. 11*a* and 11*b*, the anchoring plate 51' is modified by replacing the male connector and upstanding rib by a through hole 71 and replacing the cap formed with a socket by a cap 72 formed with a post form shank 73 (shank) having a frusto-conical, display board engaging locking barb 74 extending around the circumference separated from the cap head by an amount corresponding to the thickness of the display board 4' with the portion 75 of the post adjacent the free end forming the retention stop instead of the rib of the prior embodiment.

To anchor the strap fastener to the display board, the cap post 73 is simply poked through the aperture in the display board and pressed into the aperture 71 in the anchoring portion of the fastener until the rear shoulder of the locking barb 74 snaps into engagement with the front face of the anchoring portion 51' clamping the fastener thereto.

Figure 12:
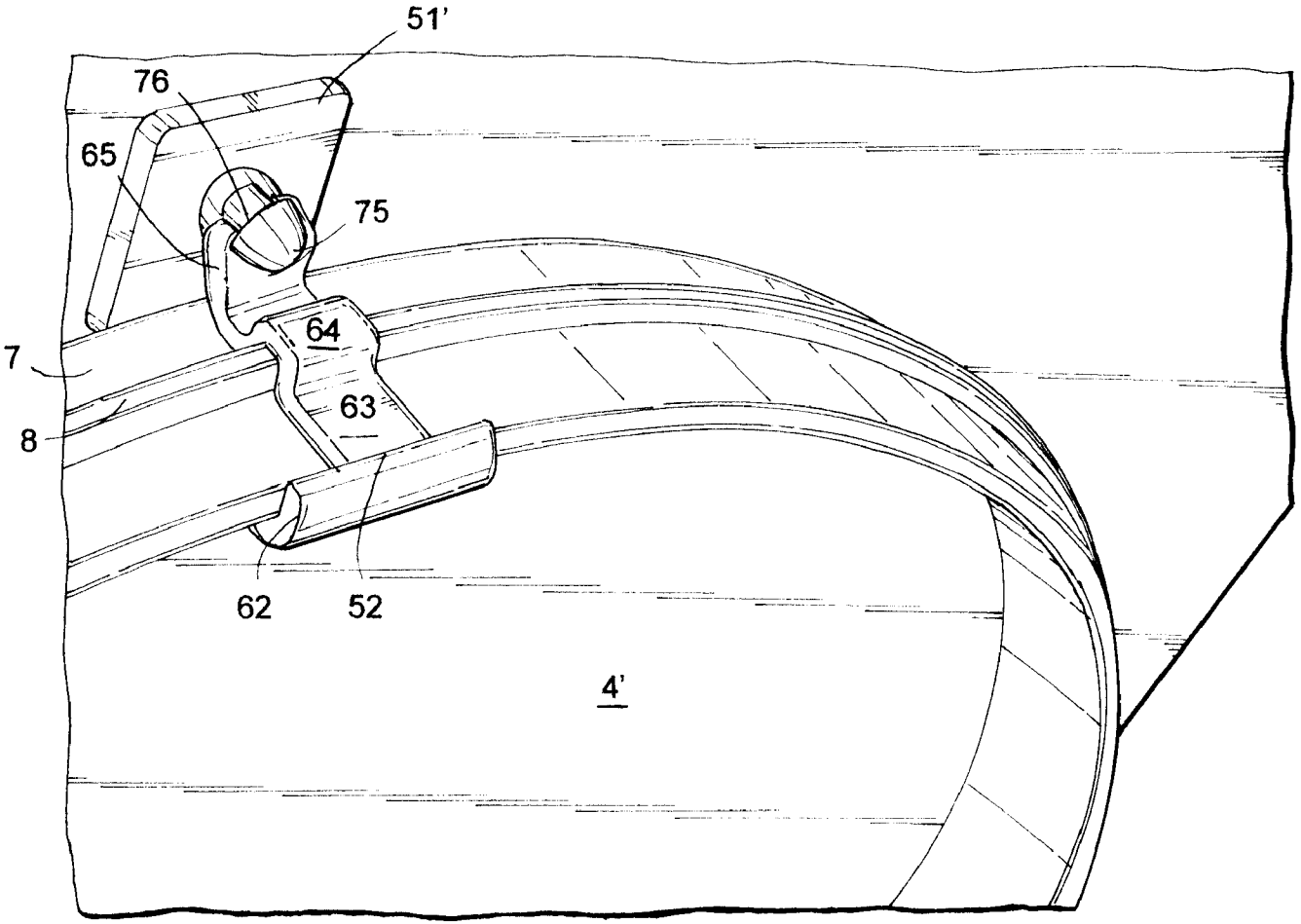
FIG. 12 is a photograph of a fastener securing a handle strap to a face of a display board.

As shown in FIG. 12, the retention stop 75 is advantageously wasted at 76 to provide a circumferential recess retaining the free end of the resilient arm of the clasp.

This embodiment facilitates speedy attachment of the handle strap to the display board. Only a single post insertion step is required to anchor the clasp to the display board instead of the tie threading steps and only two steps are required to secure the display board to the strap—strap insertion into the clasp portion of the fastener and strap rotation. This is a quicker and easier procedure than anchoring the handle strap to the display board with ties which require plural threading steps through the display board and binding around the strap, usually with a special tool and is otherwise fiddlesome and can impose a strain on the assembler's fingers.

Complete assembly of the basket is achieved by locating the lower edge portion of the display board on the shoulders of the attachment portions at ends of the strap, attaching three fasteners to the board at spaced apart strap locations of the handle strap, attaching the handle strap to the fasteners as described above to form a sub-assembly and subsequently simply pushing down the attachment portions onto the lip of the base container or basket to lock the catches in the locking apertures in the side walls thereby mounting the sub assembly onto the base container or basket.

The invention claimed is:

1. A basket assembly comprising a base container and a strap form handle therefor, the base container having an open top and being defined by opposite vertical side wall portions extending downward from horizontal top edge portions and formed with downwardly facing locking abutment surfaces and the handle being an elongate, plastic strap portion formed as a one-piece molding with a major plane and respective opposite longitudinal ends formed with handle attachment clip portions by which said handle is mounted to respective opposite sidewall portions by locking engagement with respective downwardly facing locking abutment surfaces, so that the handle upstands in bowed condition vertically above said open top, and wherein each handle attachment clip portion comprises a body portion having an upper end joining the strap portion and an outer limb and an inner limb, at least one of which limbs is resiliently flexible, depending in side by side relation from and integrally joined to outer and inner locations of a lower end of the body portion, one of the depending limbs having a catch portion which protrudes toward another of the depending limbs, said depending limbs define together a downwardly opening mouth;

so that the handle can be assembled with the base container by holding the strap portion with the mouths of the handle attachment clip portions receiving horizontal top edge portions of the side wall portions and the catch portions aligned above respective locking abutment surfaces and pushing the strap portion down causing each handle attachment clip portion to slide down the wall portion which is received between the inner and outer limbs until each catch portion snaps under each downwardly facing locking abutment surface;

wherein the strap portion of the handle has a molding integral therewith as one piece, the molding comprising a strengthening rib upstanding medially along a top, major surface thereof and the basket assembly further comprises a fastener for attaching the strap portion of the handle to a face of a display board, the fastener comprising:

a board anchoring portion integrally connected by a web hinge to a clasp portion and post means for penetrating the display board and engageable with the anchoring portion for fixing the anchoring portion to a face of the display board:

the clasp portion comprising a pair of arms extending in spaced apart, parallel relation away from the anchoring portion and joined at a remote end by a transverse arm from a central location of which a resilient latching arm extends back toward the anchoring portion and spaced above and between the pair of arms, the resilient latching arm being formed with an inverted retention channel and terminating in a free end which extends upwardly away from the pair of arms providing a widening mouth for easy insertion of the strap portion, laterally, into the clasp portion between the latching arm and the pair of arms, so that the anchoring portion can be fixed to a face of the display board by engagement with the fixing means, locating the pair of arms extending parallel to the face of the display board and the strap portion can be secured to the clasp portion by forcible lateral insertion longitudinal edge first into the mouth between the upturned free end of the latching arm and the pair of arms so as to flex the latching arm away from the pair of arms to cause the rib to snap into the retention channel which permits the latching arm to return to extend parallel to the display board trapping the strap portion in the clasp portion; and so that the clasp portion and the strap portion trapped therein can then be pivoted through a right angle about the web hinge to extend perpendicularly to the display board.

2. A basket assembly according to claim 1 wherein a clasp portion retention stop upstands from the anchoring portion so as to engage and trap the upwardly extending free end of the resilient latching arm during pivotal movement of the clasp portion and strap, thereby retaining the clasp portion and strap pivoted to extend perpendicularly to the face of the display board.

* * * * *